US008568193B1

(12) United States Patent
Evans et al.

(10) Patent No.: US 8,568,193 B1
(45) Date of Patent: Oct. 29, 2013

(54) MECHANICAL TOY APPARATUS TRANSFORMING A SYMBOLIC STRUCTURE WITH A LEVER AND METHODS THEREOF

(75) Inventors: Kevin Evans, Barrington, RI (US); Ivy Strauss, Mamaroneck, NY (US); Gary Strauss, Mamaroneck, NY (US)

(73) Assignee: Hasbro, Inc., Pawtucket, RI (US)

( * ) Notice: Subject to any disclaimer, the term of this patent is extended or adjusted under 35 U.S.C. 154(b) by 242 days.

(21) Appl. No.: 13/233,904

(22) Filed: Sep. 15, 2011

(51) Int. Cl.
*A63H 18/00* (2006.01)

(52) U.S. Cl.
USPC ..... 446/424; 446/168

(58) Field of Classification Search
USPC ..... 446/424
See application file for complete search history.

(56) References Cited

U.S. PATENT DOCUMENTS

| | | | | |
|---|---|---|---|---|
| 2,997,807 | A | 8/1961 | Woron | |
| 3,058,259 | A * | 10/1962 | Leonid Kripak | 446/397 |
| 3,765,120 | A * | 10/1973 | Waak | 446/481 |
| 3,808,730 | A | 5/1974 | Cooper et al. | |
| 3,846,933 | A | 11/1974 | Hill et al. | |
| 4,604,076 | A * | 8/1986 | St. Pierre | 446/418 |
| 4,778,432 | A * | 10/1988 | Yeu | 446/300 |
| 5,314,373 | A | 5/1994 | Caveza et al. | |
| 5,422,458 | A | 6/1995 | Simmel | |
| 6,033,286 | A | 3/2000 | Langlinais | |
| 6,557,855 | B2 * | 5/2003 | Wu | 273/369 |
| 7,862,397 | B1 | 1/2011 | Ng et al. | |
| 2003/0027482 | A1 | 2/2003 | Dumigan et al. | |

* cited by examiner

*Primary Examiner* — Michael Dennis
(74) *Attorney, Agent, or Firm* — Perry Hoffman

(57) ABSTRACT

A mechanical toy apparatus operated by a lever structure transforming a removable symbolic structure in a way that is simple yet unique and exciting for a user. A symbolic structure having a plurality of sections is configured to shift between a first collapsing position and a second rising position and is mounted at a base including a mounting portion for receiving the symbolic structure at the base. A support structure is mounted at the base for contacting and shifting the symbolic structure to the rising position and a lever structure is affixed to the base to traverse between an engaging position and a non-engaging position at the support structure. A guide structure including a cam and a slider linkage is mounted at the base with the symbolic structure contacting with the cam to move the slider linkage, the support structure is positioned into contact with the lever structure to shift the symbolic structure to the second rising position.

18 Claims, 12 Drawing Sheets

MECHANICAL TOY APPARATUS TRANSFORMING A SYMBOLIC STRUCTURE WITH A LEVER AND METHODS THEREOF

BACKGROUND OF THE INVENTION

1. Field of the Invention

The present invention relates to toys, and more particularly to a mechanical toy apparatus operated by a lever structure transforming a removable symbolic structure in a way that is simple yet unique and exciting for a user. The invention also relates to methods for transforming a symbolic structure with a lever structure in a toy or toy play set apparatus.

2. Background of the Invention

There are many known toys and toy play sets which incorporate assemblies for small kitchen appliances and simulated food products for the purpose of making make play time more exciting for a child. Engaging and activating the various toy appliances is accomplished through several different mechanisms which all strive to mimic the actions and reactions of real kitchen appliances and real food products.

For example, there are several known toy toasters incorporating a spring biased lever operable with a timing mechanism, gear mechanism or vacuum cup for simulating toast "popping up" from a toaster, as exemplified and disclosed in U.S. Pat. No. 3,765,120 issued Oct. 16, 1973 to Waak. A toy base resembling a toaster includes slots for receiving toy bread which is lowered into the base by depressing the biased lever and held for a time within the toaster simulating the toasting process. The toast is then "popped up" from inside the toaster allowing a user to access the toast from outside the base when the biased lever is released. The toast may also be turned while inside the toaster to a side of the bread which is colored to resemble cooked toast before "popping up" out of the toy toaster.

A known toy kitchen disclosed in U.S. Patent Publication No. 0027482 A1, published Feb. 6, 2003 to Dumigan et al. teaches a toy kitchen body included with pressurized gas disposed therein and having multiple openings adapted to enable the pressurized gas to escape and provide energy to a number of associated objects operatively engaging the kitchen body. A plurality of toy appliances are operatively associated with the kitchen body and are configured to utilize the pressurized air to achieve visual and audio effects such as blending food, toasting bread, baking bread, and frying toy food, etc. When baking toy bread for example, the pressurized gas escapes through holes in the kitchen base and fills a cavity of a baking pan covered by an expanding material which rises when filled with the pressurized gas expanding and simulating rising dough.

Another known toy utilizing pressurized air is disclosed in U.S. Pat. No. 3,846,933 issued Nov. 12, 1974 to Hill et al. showing a pneumatic toy stove accessory which delivers pressurized air to toy food products that rise when baked. The stove is coupled to a supply of air under pressure and is equipped to release the air into various simulated food items which each include a stretchable diaphragm decorated to simulate uncooked food when in a relaxed condition and cooked food when in a distended condition. The stove also includes an aperture in communication with the food items for bleeding the air therefrom.

A known toy oven disclosed in U.S. Pat. No. 6,033,286 issues Mar. 7, 2000 to Langlinais discloses a conveyor belt coupled to the toy oven for moving pretend food product through the oven mimicking the cooking process. The toy oven includes a hinged door providing access to an oven cavity with the an endless conveyor belt secured to spools on either end passing through the oven cavity for movement of toy food product through the oven by a user turning a hand-operated wheel.

In further known toy ovens which utilize child-oriented edible food products several mechanisms are taught to quickly cool the food product, or compress and/or grind then compress the food product in an effort to appeal to a young child's desire to make their own food products. For example, as disclosed in U.S. Pat. No. 5,422,458 issued Jun. 6, 1995 to Simmel, cooling air is forced into a heating chamber of the toy oven after the product has been sufficiently heated/cooked to substantially reduce the time period required to safely handle the heated/cooked product. An integrated timer controlled actuation and locking system automatically prevents access to the heating chamber when the heating/cooking process is taking place and product is too hot to touch. The actuation system automatically engages and sequentially times the heating and cooling cycles.

In another example, as disclosed in U.S. Pat. No. 5,314,373 issued May 24, 1994 to Caveza et al. a toy food processor and simulated oven utilizes crushable food material, such as crackers, which are crushed in the processor when a user turns a crank. The crushed food material flows to a tray where the user retrieves and presses it into a cookie shape then slides the cookie tray into the oven chamber which positioned below the processor. A darker food product, such as powdered chocolate or cinnamon is deposited into a sprinkler accessory mounted above the oven and flows onto the shaped cookies simulating browning.

In another example, as disclosed in U.S. Pat. No. 3,808,730 issued May 7, 1974 to Cooper et al. a telescopic food mold is inserted into a toy oven for reconstituting a compressible food product contained within the mold. The mold filled with the compressible food product is covered and placed into the oven between upper and lower walls. One of the walls moves toward the other when the oven door is closed to compress the mold and thus compress and reconstitute the food product contained therein to simulate baking a cake.

A known mechanical toy which simulates a cupcake with a lit candle operable to be blown out by a user is disclosed in U.S. Pat. No. 7,862,397 issued Jan. 4, 2011 to Ng et al. The mechanical toy includes a base in the shape of a cupcake, a simulated flame structure movable between an exposed-to-view position and a hidden-to-view position within a candle structure. A spring biased support structure supports the flame in the exposed position and a slight lateral force causes the flame to move to the hidden position.

Significantly, known toys do not include a mechanical toy apparatus operated by a lever structure for transforming a removable symbolic structure in a way that is simple yet unique and exciting for a user. It would be desirable to provide a symbolic structure mounted on a base and actuating a cam at the base for moving a support structure into engagement with the symbolic structure. The lever structure is operable to lift the support structure and shift the symbolic structure to a rising position from a collapsed position.

SUMMARY OF THE INVENTION

The present invention addresses shortcomings of the prior art to provide a mechanical toy apparatus simply operated by a lever structure transforming a removable symbolic structure in a way that is unique and exciting for a user. A symbolic structure having a plurality of sections is mounted on a base actuating a cam at the base for engaging the support structure.

The lever structure is operable to lift the engaged support structure shifting the plurality of sections of the symbolic structure to a rising position.

In one embodiment of the invention, a mechanical toy apparatus includes a symbolic structure having a plurality of sections configured to shift between a first collapsing position and a second rising position, a base including a mounting portion for receiving the symbolic structure at the base, a support structure mounted at the base for contacting and shifting the symbolic structure to the rising position, a lever structure affixed to the base to traverse between an engaging position and a non-engaging position at the support structure, and a guide structure comprising a cam and a slider linkage mounted at the base. The symbolic structure contacting with the cam move the slider linkage and the support structure is positioned into contact with the lever structure to shift the symbolic structure to the second rising position.

In another embodiment of the invention, the support structure further includes a protrusion at an end of the support structure wherein the lever structure engages and lifts the support structure at the protrusion. In another embodiment, the slider linkage at least partially envelopes the support structure biasing the support structure out of engagement with the symbolic structure.

In another embodiment of the invention, a platform is further included at the mounting portion of the base upon which the removable symbolic structure is mounted and in mechanical communication with the cam, the platform further includes an aperture through which the support structure extends to shift the symbolic structure to the second rising position. In another embodiment, a second lever and a linkage, wherein the linkage couples the second lever to the lever structure is further included to traverse the lever structure between an engaging position and a non-engaging position.

In still another embodiment of the invention, the second lever further includes a door affixed to traverse between a first closed position and a second open position at the base and in mechanical communication with the linkage, wherein the door causes the lever structure to move to the engaging position causing the support structure to raise the mounted symbolic structure to the second rising position when the door is opened to the second position, and further allowing the support structure to drop from mechanical communication with the symbolic structure when the door moves the lever structure to the non-engaging position.

In another embodiment of the invention, the plurality of sections of the symbolic structure further includes one or more telescoping tiers extending from a fixed tier. The fixed tier is further mounted on a plate and including an edge for actuating the cam and an aperture through which the support structure extends to shift the one or more telescoping tiers to the second rising position.

In one embodiment of the invention, at least one of the telescoping tiers includes a portion having an interior ledge and at least one adjacent telescoping tier includes a portion having an exterior ridge forming a pressure fit between adjacent tiers for maintaining the tiers in a rising position when the exterior ridge abuts the interior ledge. In another embodiment, the one or more telescoping tiers includes a top tier which further includes a post having a surface for engagement with the support structure. In still yet another embodiment, the base further includes one or more guiding ledges which define one or more slots at the platform for receiving the plate edge for actuating the cam and maintaining alignment of the plate and platform apertures.

In yet another embodiment, a mechanical toy apparatus for use in a toy play set includes a play set, an extension wall removably affixed to the play set, a symbolic structure having a plurality of sections configured to shift between a first collapsing position and a second rising position, a base affixed to the extension plate and including a mounting portion for receiving the symbolic structure at the base, a support structure mounted at the base for contacting and shifting the symbolic structure to the rising position, a lever structure affixed to the base to traverse between an engaging position and a non-engaging position at the support structure, and a guide structure comprising a cam and a slider linkage mounted at the base. The symbolic structure contacting with the cam moves the slider linkage, the support structure is positioned into contact with the lever structure to shift the symbolic structure to the second rising position.

In still yet another embodiment of the invention, the slider linkage at least partially enveloping the support structure and biases the support structure out of engagement with the symbolic structure. In another embodiment, a platform is further provided at the base upon which the removable symbolic structure is mounted and in mechanical communication with the cam, the platform further including an aperture through which the support structure extends to move the symbolic structure to the rising position. In still yet another embodiment of the invention, a second lever is further provided and affixed at the lever structure to traverse the lever structure between an engaging position and a non-engaging position.

In one embodiment of the invention, a method for transforming a symbolic structure with a lever structure in a toy or toy set apparatus includes the steps of providing a symbolic structure having a plurality of sections configured to transform between a first collapsing position and a second rising position, providing a base including a mounting portion for receiving the symbolic structure at the base, providing a support structure mounted at the base for contacting and enabling the symbolic structure to transform to the rising position, providing a lever structure affixed to the base to traverse between an engaging position and a non-engaging position at the support structure, and providing a cam mounted at the base for moving the support structure into engagement with the symbolic structure. Mounting the symbolic structure at the base actuates the cam, and moving the lever structure to the engaging position causes the support structure to transform the symbolic structure to the rising position.

In another embodiment of the invention, the method further includes providing a platform at the base upon which the removable symbolic structure is mounted and in mechanical communication with the cam, the platform further including an aperture through which the support structure extends to transform the symbolic structure to the rising position. In yet another embodiment of the invention, the plurality of sections of the symbolic structure further includes one or more telescoping tiers extending from a fixed tier.

In still yet another embodiment of the invention, the steps of mounting the fixed tier on a plate and mounting the plate on the platform are further included, wherein the plate also includes an edge for actuating the cam and an aperture through which the support structure extends to transform the one or more telescoping tiers to the rising position. In another embodiment of the invention, a play set and an extension wall removably affixed to the play set is further included, and further including the steps of mounting the base to the extension wall and removably coupling the wall to the play set.

BRIEF DESCRIPTION OF THE DRAWINGS

For the purpose of facilitating an understanding of the inventions, the accompanying drawings and description illustrate a preferred embodiment thereof, from which the inventions, structure, construction and operation, and many related advantages may be readily understood and appreciated.

FIG. 1A is a perspective view of a mechanical toy apparatus of the present invention illustrating a symbolic structure mounted in a first collapsing position on a base and actuating a cam; while FIG. 1C illustrates a lever structure shifting the symbolic structure to a second rising position; while

FIG. 3A is a top view of an embodiment of the present invention illustrating a platform at a mounting portion of the base including an aperture through the platform through which the support structure is shown biased out of alignment with the aperture; while

FIG. 4A is a front view of an embodiment of the present invention illustrating a door traversed to a first closed position with a collapsed symbolic structure mounted at the base; while

FIG. 5A illustrates a telescoping plurality of sections of the symbolic structure shifted to the second rising position; while

FIG. 9A is a perspective view of an embodiment of the present invention illustrating the base as a stand alone toy oven showing the symbolic structure mounted at the mounting portion inside the oven with the door traversed to the second open position causing the symbolic structure to shift to the second rising position; while

DETAILED DESCRIPTION OF THE EMBODIMENTS

Figure 1A:
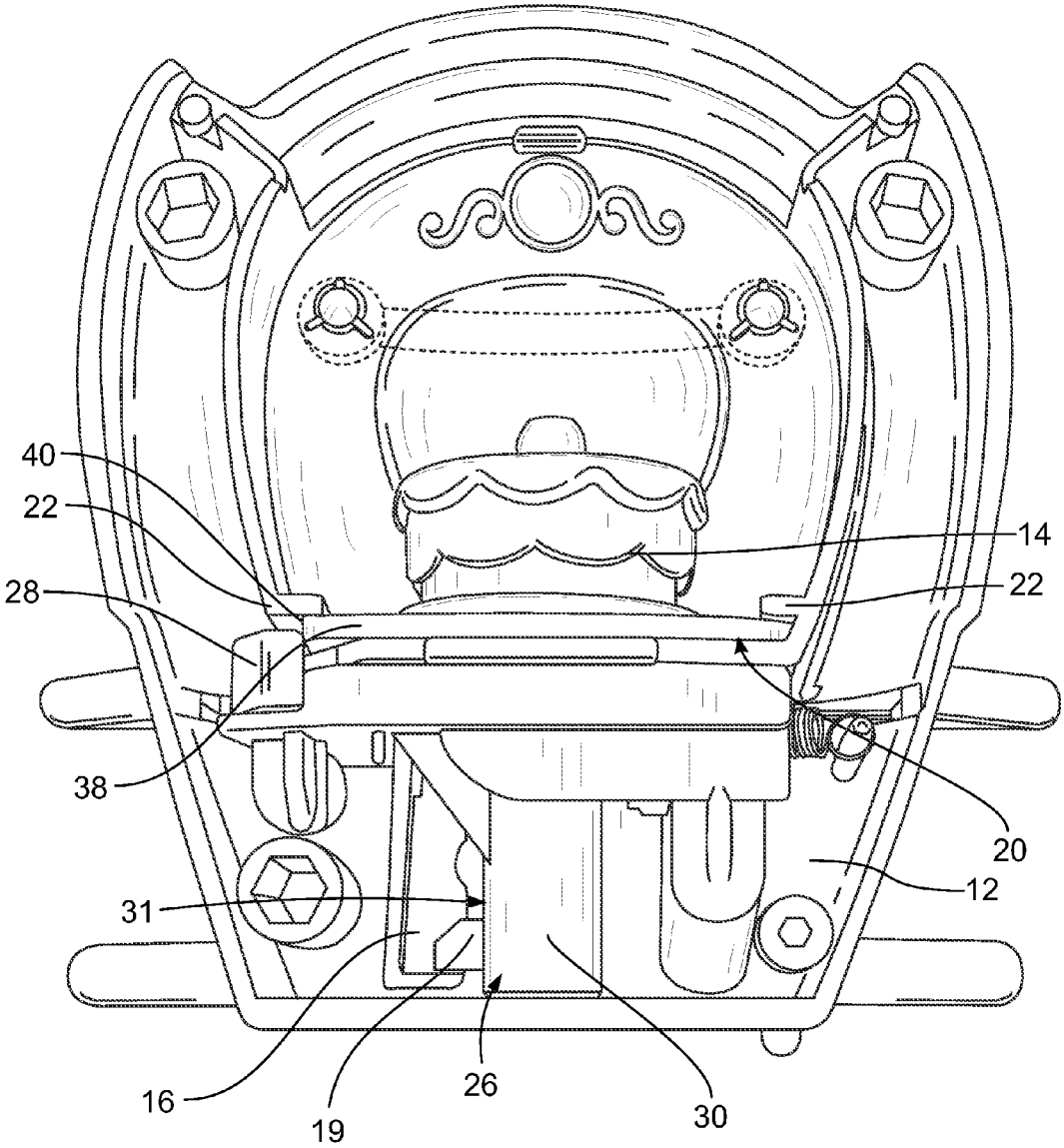

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope to the present invention.

A mechanical apparatus 10, as seen in FIGS. 1A-1D, is seen to include a base 12 with a symbolic structure 14 mounted thereon. A lever structure 16 moves a support structure 18 to shift the symbolic structure to a rising position from a collapsing position thereby transforming the symbolic structure in a way that is simple yet unique and exciting for a user.

In the present described invention, the base 12, as seen in FIGS. 1-4, is generally seen to be constructed from a single piece of molded heavy duty plastic shaped to look like a toy oven. Heavy duty plastic is simple and inexpensive to mold into a desired shape and can easily include fun colors. It is also contemplated that the base can include any number of alternative shapes including other toy oven shapes such as a microwave oven, cupcake tray or chamber for expanding products such as balloons, etc.

Figure 2:
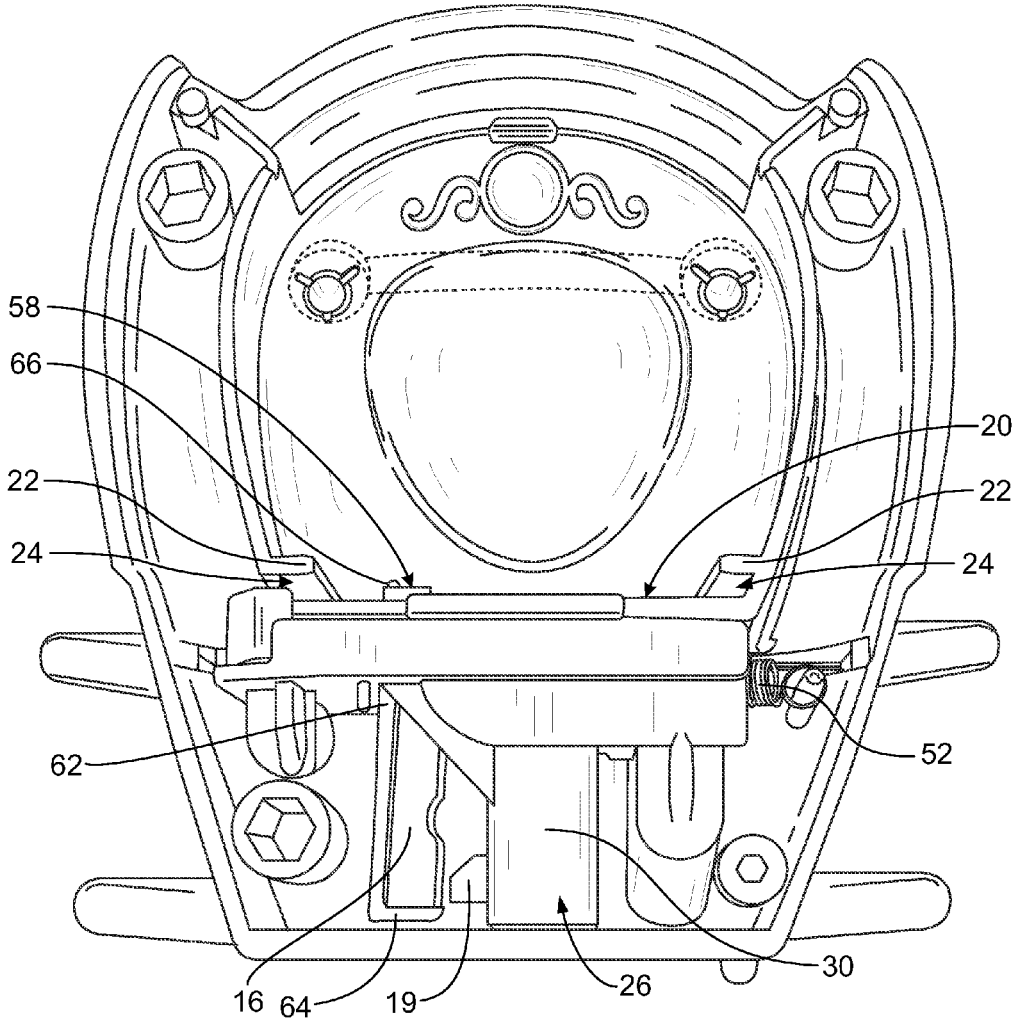
FIG. 2 is a rear view of an embodiment of the present invention illustrating a guide structure at least partially enveloping the support structure in mechanical communication with the cam and biasing the support structure out of engagement when the symbolic structure in not mounted on the base actuating the cam.
Figure 3A:
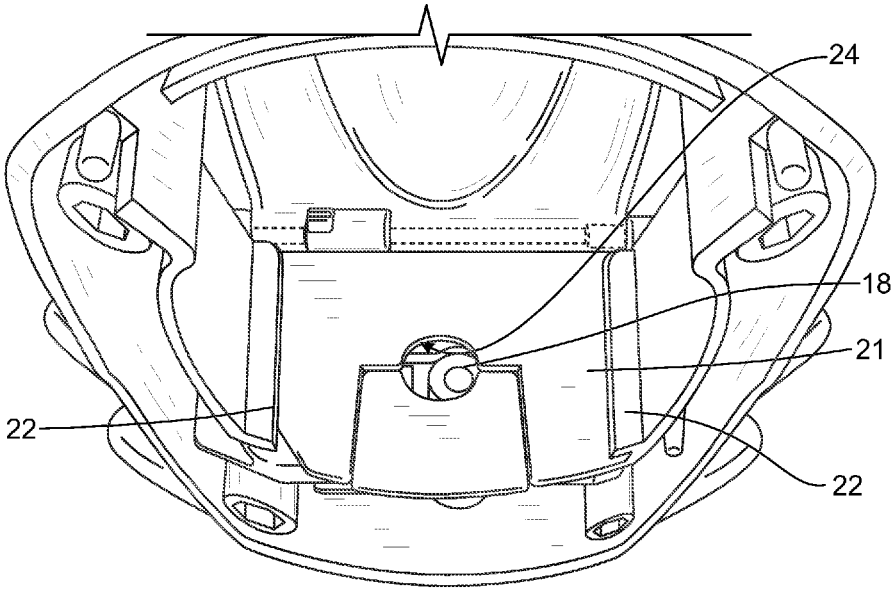
Figure 3B:
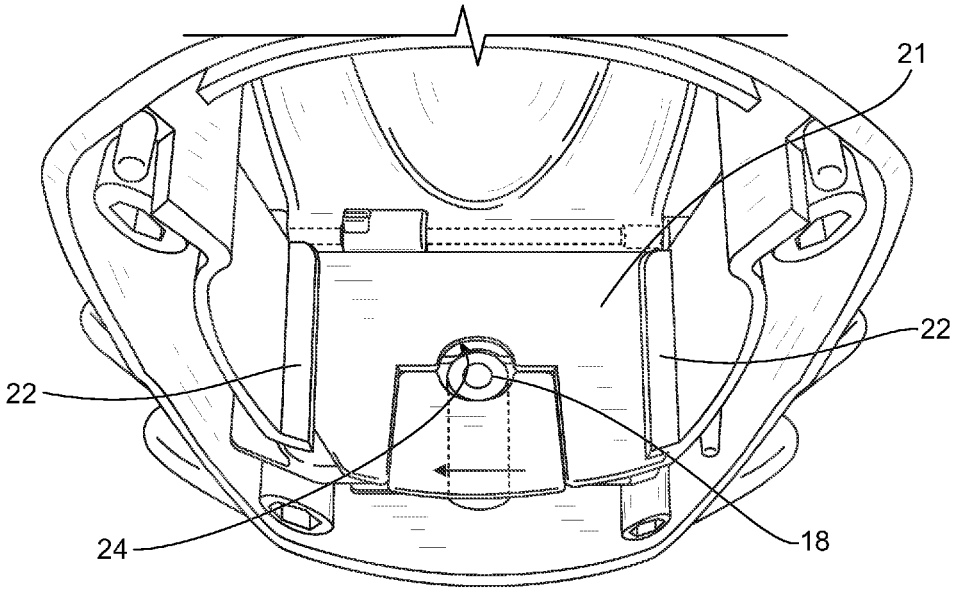
FIG. 3B illustrates the support structure in alignment with the aperture and operable to extend there through to shift the symbolic structure to the second rising position.

The base 12, as seen in FIG. 1, includes a mounting portion 20 for receiving the symbolic structure 14 at the base. The base further includes a platform 21 at the mounting portion upon which the removable symbolic structure is mounted, and one or more guiding ledges 22 defining one or more slots 24, as seen in FIG. 2, at the mounting portion 14 adjacent the platform 21 for securing and positioning the symbolic structure 14 at the base. The platform 21 of the base further includes an aperture 24, as seen in FIGS. 3A and 3B, through which the support structure 18 extends to shift the symbolic structure to the second rising position.

Figure 1B:
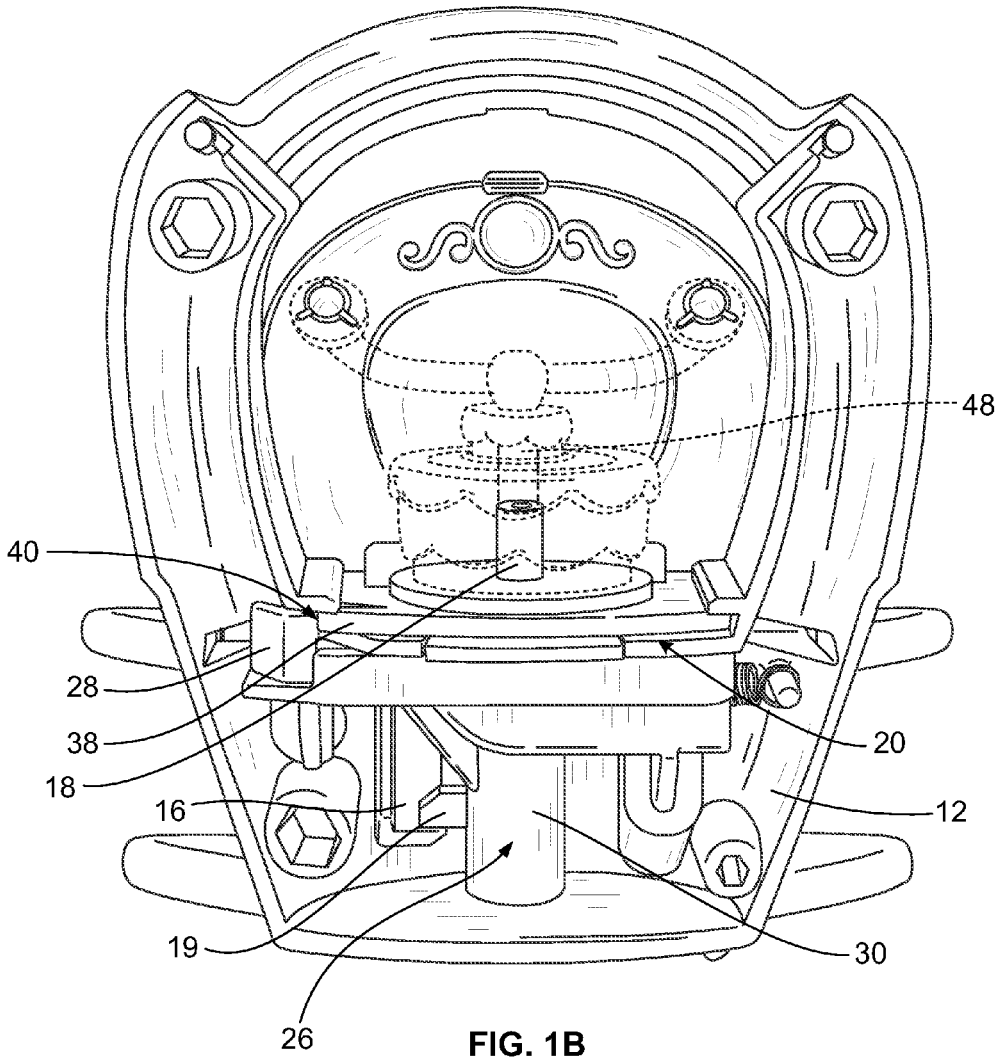
FIG. 1B illustrates a support structure in the process of shifting the symbolic structure, shown in phantom to see the support structure.

The support structure 18 is mounted at the base 12, and in the present described embodiment, is seen to be constructed from heavy duty plastic providing a rigid structure strong enough for contacting and shifting the symbolic structure to the second rising position, as seen in FIG. 1B. The support structure 18 includes a protrusion 19 at an end of the support structure wherein the lever structure 16 engages and lifts the support structure at the protrusion 19. In the present described embodiment, the protrusion 19 is integral with the support structure, however a securely affixed protrusion is also contemplated.

Figure 1C:
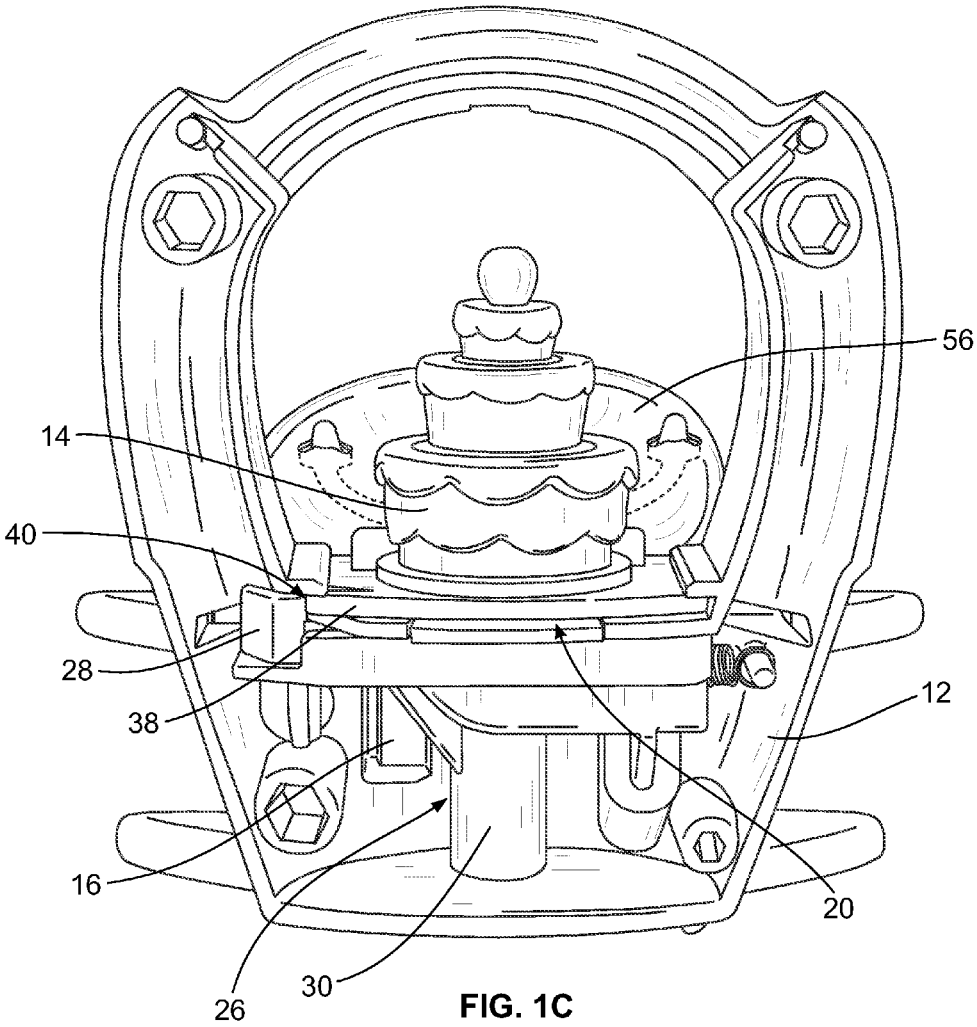
Figure 1D:
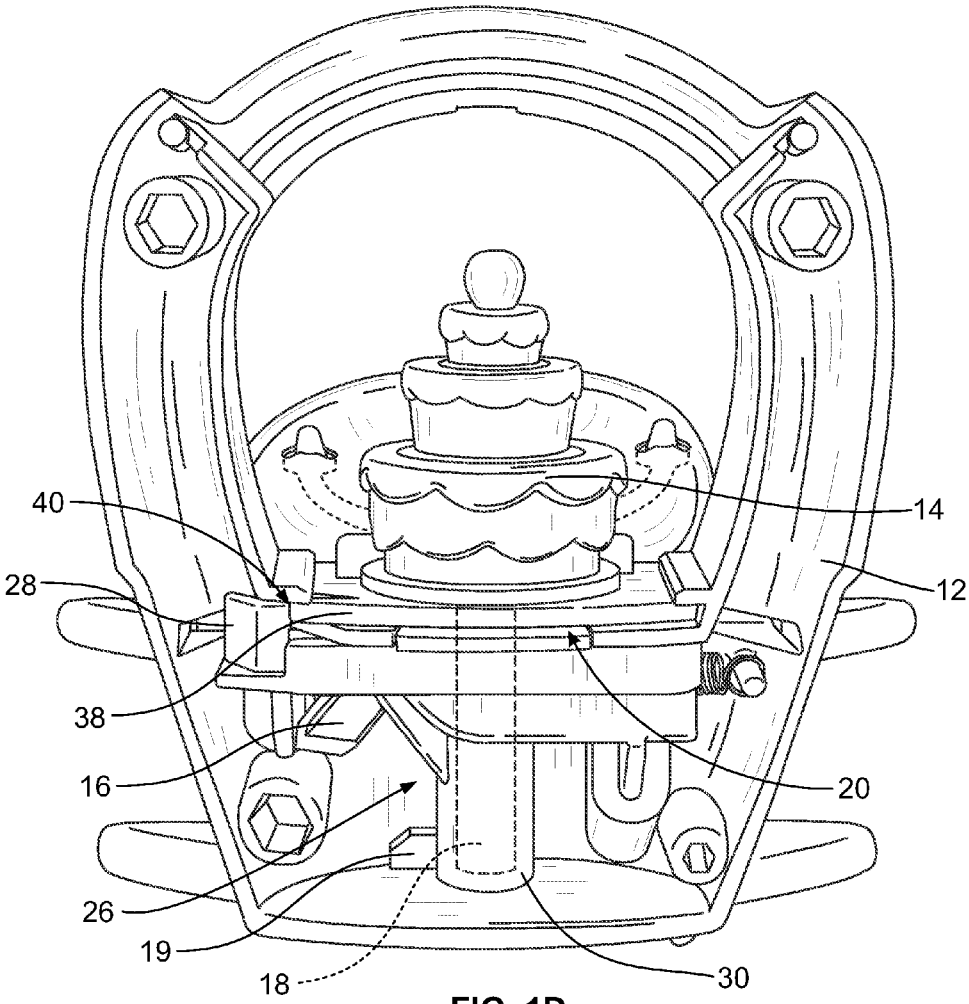
FIG. 1D illustrates the lever structure disengaged causing the support structure to fall from engagement allowing the symbolic structure to be removed in the risen position from the base.

The lever structure is also affixed at the base to traverse between an engaging position, as seen in FIGS. 1B and 1C, and a non-engaging position, as seen in FIGS. 1A and 1D at the support structure. Also included and seen in FIGS. 1A-1D, is a guide structure 26 including a cam 28 and a slider linkage 30 mounted at the base 12, with the symbolic structure contacting with the cam 28 to move the slider linkage 30.

In the present described embodiment, as seen step by step in use in FIGS. 1A-1D, the symbolic structure 14, including a 3 tiered cake, is mounted in a collapsed position on the platform 21 at the mounting portion of the base 12, which includes a toy oven, as seen in FIG. 1A. The mounted symbolic structure 14 is in mechanical communication with the cam 28 and actuates the cam 28 causing movement of the slider linkage 30 into an activation position which in turn moves the support structure 18 into contact with the lever structure 16 at the protrusion 19. Alternatively the mounted symbolic structure 14 may be embodied, e.g., as cupcakes rising in cupcake tray, candles rising on birthday cake and the like in cooperation with base 12 which may be embodied as the described oven, chamber, cupcake tray or birthday cake accordingly. The lever structure 16 begins to lift the support structure 18 at the protrusion 19, as seen in FIG. 1B, extending the support structure into the symbolic structure to begin shifting the cake to the rising position. The lever structure continues to extend further lifting the support structure to shift the cake to a fully risen position revealing hidden portions of the symbolic structure, as seen in FIG. 1C. The lever structure then contacts slider linkage 30 moving laterally with respect to the protrusion 19 causing release of the protrusion 19 allowing the protrusion and integral support structure to fall from engagement with the symbolic structure 14, as seen in FIG. 1D. The symbolic structure 14 or risen cake can now be removed from the base 12 or oven in the risen position.

Figure 5A:
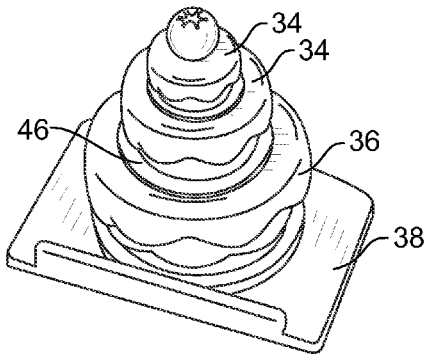
Figure 5B:
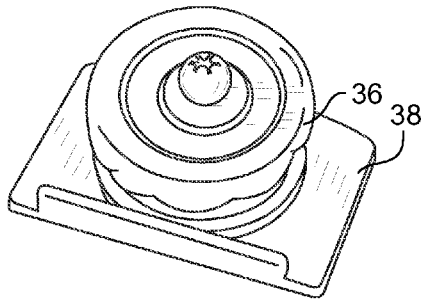
FIG. 5B illustrates the plurality of sections of the symbolic structure shifted to the first collapsing position.
Figure 6:
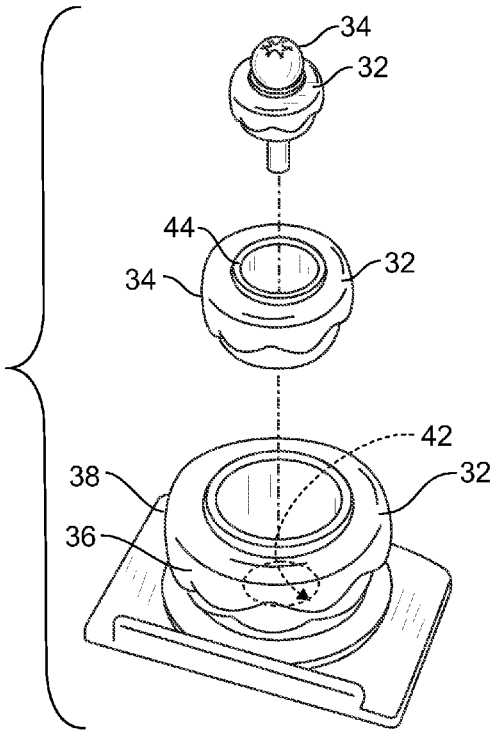
FIG. 6 is an exploded view of the plurality of sections of the symbolic structure illustrating an interior ledge of a telescoping tier and an exterior ridge of an adjacent telescoping tier forming a pressure fit between tiers to maintain the tiers in a second rising position.

The symbolic structure 14, as seen in FIGS. 5-6 has a plurality of sections 32 configured to shift between a first collapsing position, as seen in FIGS. 1A and 5B and a second rising position, as seen in FIGS. 1C and 5A. In the present described invention, as seen in FIGS. 5-6 the plurality of sections 32 further includes one or more telescoping tiers 34 generally seen to be constructed of molded heavy duty plastic and shaped to look like tiers of a cake. Heavy duty plastic is simple and inexpensive to mold into a desired shape and can easily include fun colors.

The telescoping tiers 34 extend from a fixed tier 36, as seen in FIGS. 5-6. The fixed tier 36 is further mounted on a plate 38 which includes an aperture 42 and is operable to be mounted on the mounting portion 22 of the base 12, as described above. The plate 38 further includes an edge 40 which is received into the one or more slots 24 of the one or more guiding ledges 22 for actuating the cam 28 and maintaining alignment of the plate and platform apertures, 42 and 24 respectively. The support structure 18 extends through both plate and platform apertures, 42 and 24 respectively, to shift the one or more telescoping tiers to the second rising position, as seen in FIG. 1B.

In the present described invention, at least one of the telescoping tiers 34 includes a portion having an interior ledge 44 and at least one adjacent telescoping tier includes a portion having an exterior ridge 46 forming a pressure fit between adjacent tiers for maintaining the tiers in a rising position when the exterior ridge abuts the interior ledge, as seen in FIGS. 5-6. The tiers of the symbolic structure, as seen in FIG. 5B, collapses with gaps maintained between the tiers such that when the tires rise, the exterior ridges are exposed to fill the gaps and form a tight fit between the tiers. The interior ledge sits adjacent the exposed exterior ridges further supporting the tight fit between the tiers. This configuration of the tiers in the present described invention further allows the symbolic structure to maintain the risen position when removed from the base enhancing play for the user. The user, which is usually a young child, would take great pleasure in causing a cake to rise in a toy oven and then being able remove the cake in a risen position for further play.

Figure 7:
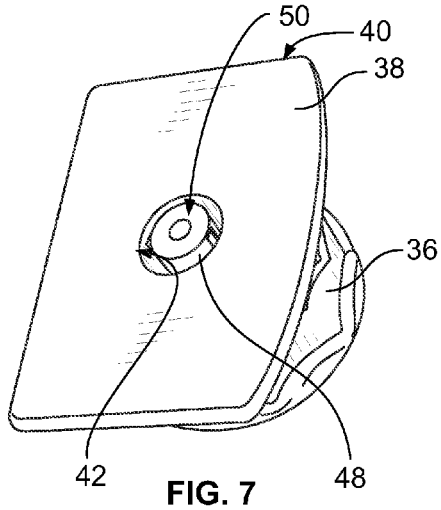
FIG. 7 illustrates a post affixed to the symbolic structure and extending to an aperture of a plate upon which the symbolic structure is mounted and through which the support structure extends to engage the post.

In the present described invention, one or more telescoping tiers includes a top tier which further includes a post 48, as seen in FIGS. 1B and 7, having a surface 50 for engagement with the support structure. The post 48 extends to the aperture 42 of the plate 38 and in the present described embodiment is constructed from heavy duty plastic and rigid enough to support the telescoping tiers as they are shifted to the rising position.

In the present described embodiment, the slider linkage 30 of the guide structure 26 at least partially envelopes the support structure, as seen in FIG. 1D. The slider linkage 30 includes a slot 31 along a length of the linkage to accommodate the protrusion extending beyond the slider linkage as the support structure is slid up and down the length of the slider linkage, as seen in FIGS. 1A-1D.

The slider linkage 30 biases the support structure from engagement with the symbolic structure. As seen in FIG. 2, a spring 52 is coupled to the base 12 at one end and to the slider linkage 30 at an opposite end biasing the support structure from alignment with aperture 24 of the platform preventing the support structure from rising from the slider linkage 30, as seen in FIG. 3A.

Mounting of the plate 38 and affixed symbolic structure causes activation of the cam 28, as seen in FIGS. 1A-1D, causing the slider linkage 30 to move the support structure into alignment with aperture 24, as seen in FIG. 3B. Alignment of plate and platform apertures, 42 and 24 respectively, allows lever structure 16 to shift the symbolic structure to the second rising position when lever structure 16 is activated by the user.

Figure 4A:
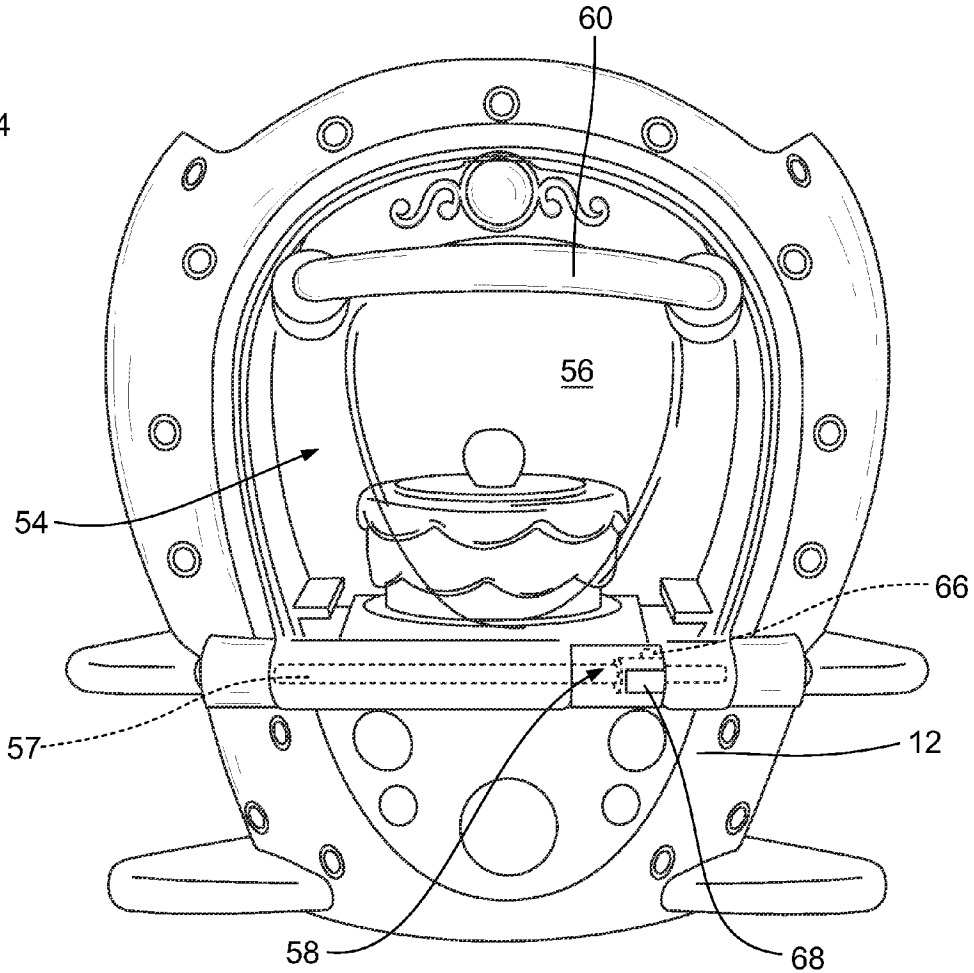
Figure 4B:
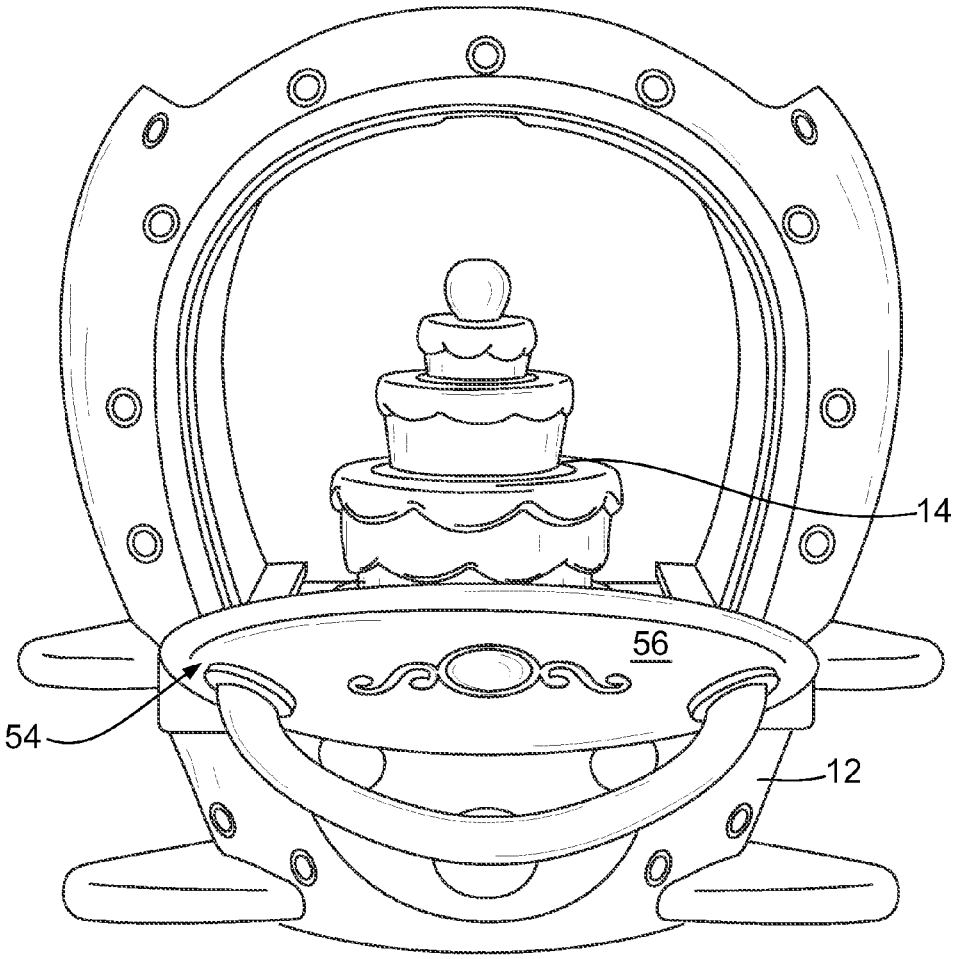
FIG. 4B illustrates a door affixed at the base in a second open position with the symbolic structure shifted to a rising position.

A second lever 54 affixed at the lever structure 16 traverses the lever structure 16 between an engaging position and a non-engaging position, as seen in FIGS. 4A and 4B. The second lever 54 further includes a door 56 affixed to traverse between a first closed position, as seen in FIG. 4A, and a second open position, as seen in FIG. 4B at the base 12. The door 56 is in mechanical communication with the lever structure 16 causing the support structure to raise the mounted symbolic structure to the second rising position when the door is opened to the second position, as seen in FIG. 4B.

In the present described embodiment, the door 56 is pivotably secured to the base along a pin 57 adjacent the platform 21 and includes a handle 60 for ease in opening and closing the door, as seen in FIG. 4B. The door 56 is generally transparent, as seen in FIG. 4A, so a user can see the symbolic structure rising through the door further enhancing the play experience. In addition to or instead of using the door 56, the activation device may be embodied to include rotating or sliding a knob when the door is closed in cooperation with the hidden linkages, e.g. with a rotating post or a sliding bar, etc.

Additionally, a linkage 58, as seen in FIGS. 2 and 4A is coupled to the lever structure 16 at an end 62 opposite an end 64 that engages the protrusion 19 and is also rotatably secured at the pin 57 and in mechanical communication with the door 56. As the door 56 is opened, as seen in FIGS. 1B-1C, linkage 58 rotates with the pivoting door advancing the coupled lever structure to engage the protrusion 19 and lift the support structure to shift the symbolic structure to a second rising position when the symbolic structure is mounted at the platform actuating the cam 28. Additionally, further advancement of the door and lever structure, as seen in FIG. 1D, causes the lever to contact the guide structure and move laterally with respect to the protrusion 19, as described above, moving the lever structure to the non-engaging position as the protrusion is released causing the support structure to drop from mechanical communication with the symbolic structure. Also, closing the door to the first position also moves the lever structure to the non-engaging position, as seen in FIG. 1A.

The linkage 58 further includes a first protrusion 66 which abuts between the door and the platform when the door is in a closed position, as seen in FIG. 2, further facilitating the correct placement of the lever structure 16 adjacent the protrusion when the door is closed. The linkage 58 also includes a stop protrusion 68 in mechanical communication with the door 56 preventing the opened door from damaging the coupled lever structure by opening too far past a non-engaging position and what is necessary to actuate the lever structure and then release the protrusion, as seen in FIGS. 1D and 4B. The lever structure contacts the guide structure 30 when releasing the protrusion, as seen in FIG. 1D, such that damaging advancement of the lever structure toward the guide structure by further opening the door beyond activation of the lever and subsequent release of the protrusion 19 is prevented by the stop protrusion 68.

Figure 8A:
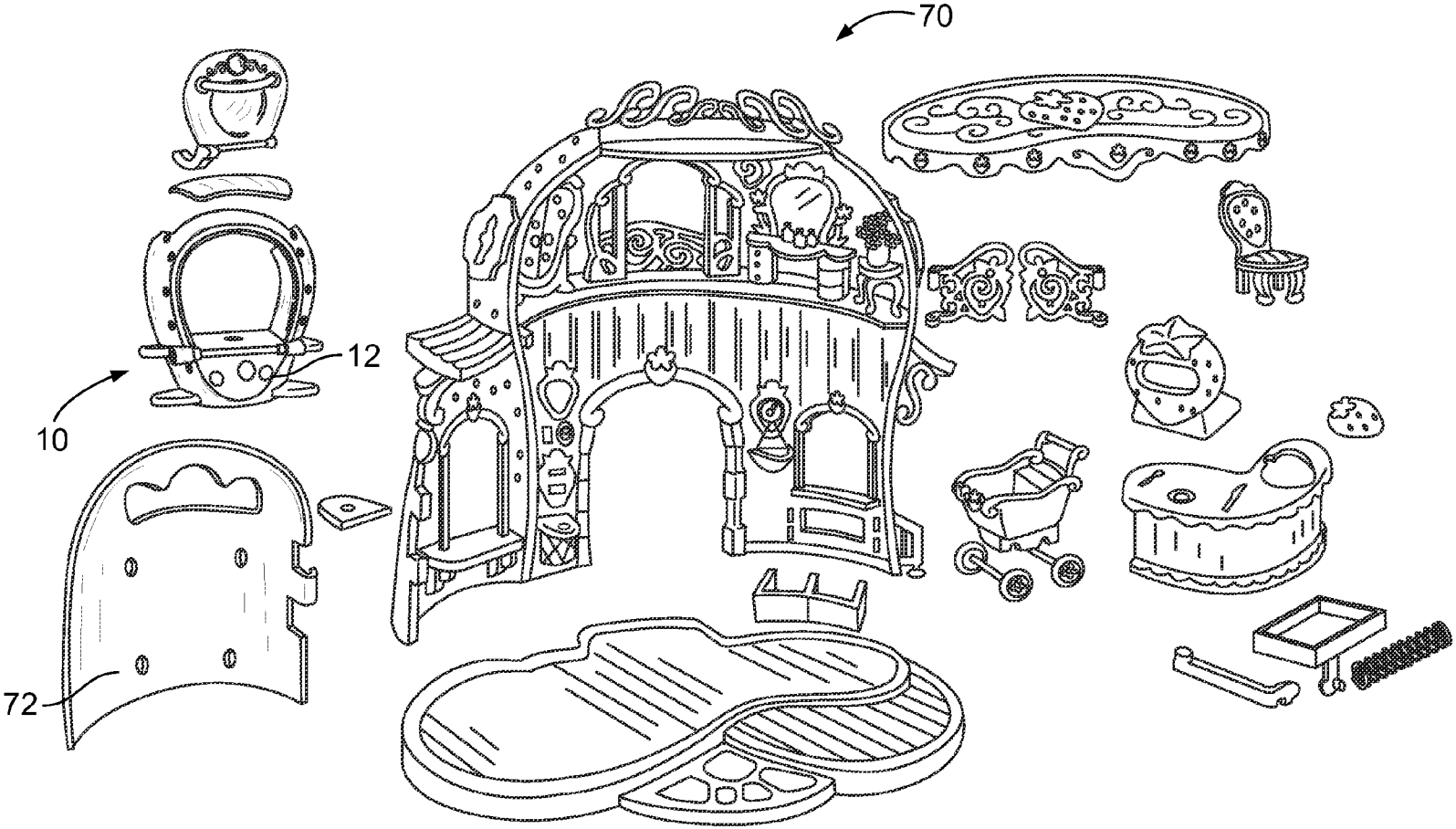
FIGS. 8A and 8B illustrate an embodiment of a mechanical toy apparatus of the present invention operable with a toy play set and showing an extension wall affixed to the base for removably affixing the base to a toy play set.
Figure 8B:
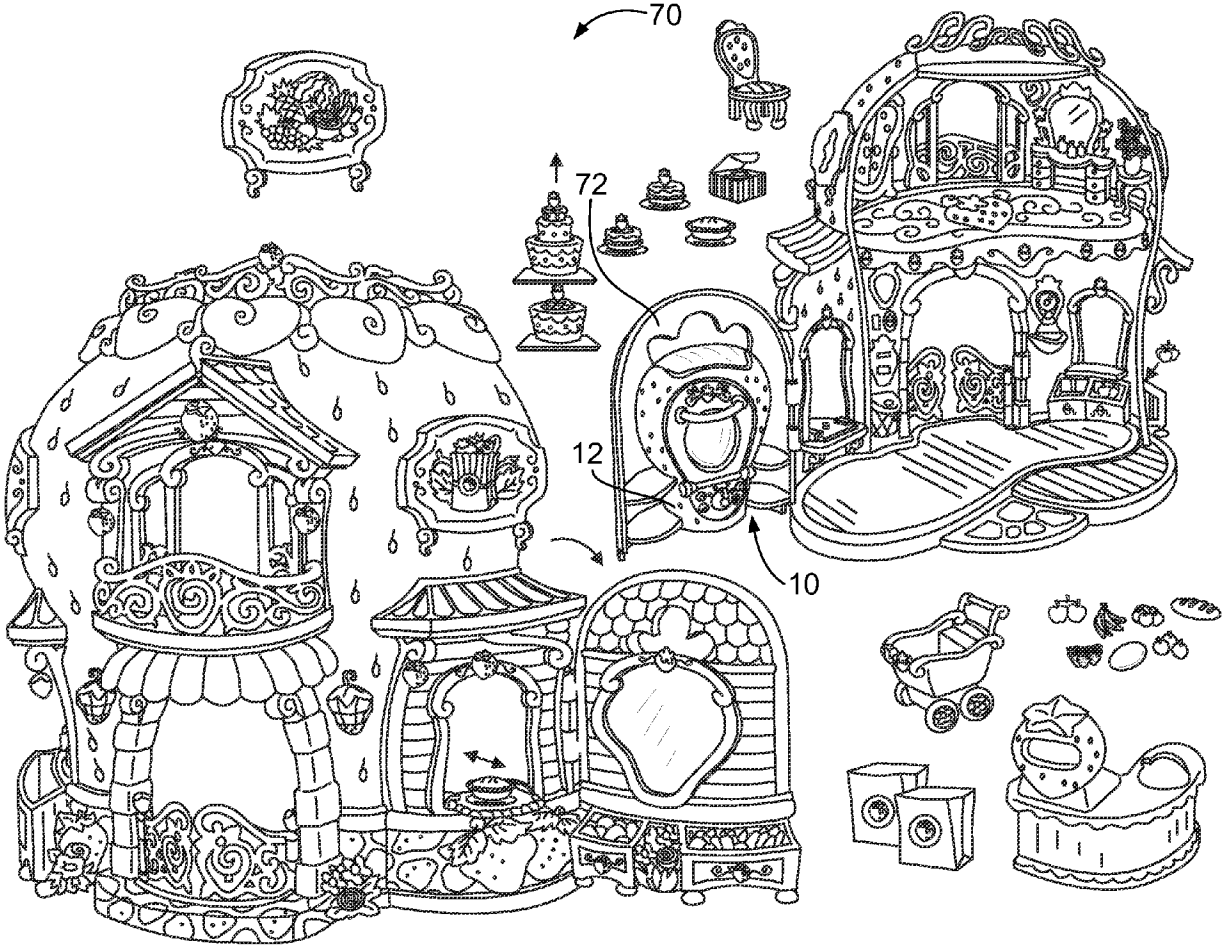

In the present described embodiment of the invention, the mechanical toy apparatus 10 is used in a toy play set 70, as seen in FIGS. 8A and 8B. An extension wall 72 is removably affixed to the toy play set 70 and the base 12 is affixed to the extension wall 72 for coupling the mechanical toy apparatus 10 to a larger incorporated play set. As seen in FIGS. 8A and 8B, the child using the play set, which is generally seen to be shaped like a house or cottage, can include a pivotably coupled extension wall 72 which introduces a toy oven operable to mount a cake which can be shifted to a risen position by actuating the door of the oven. The child can then remove the cake in a risen position for further play. Pivotably coupling the extension wall 72 with attached toy oven to the play set also allows the oven to be neatly folded up into the toy play set for easy storage.

Figure 3C:
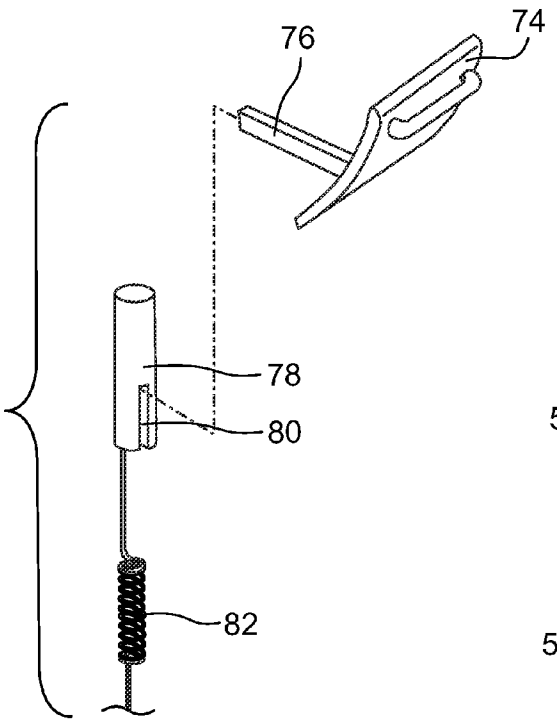
FIG. 3C illustrates an embodiment of the present invention with the support structure including a spring biasing dropping the support structure from extension through the aperture.
Figure 9A:
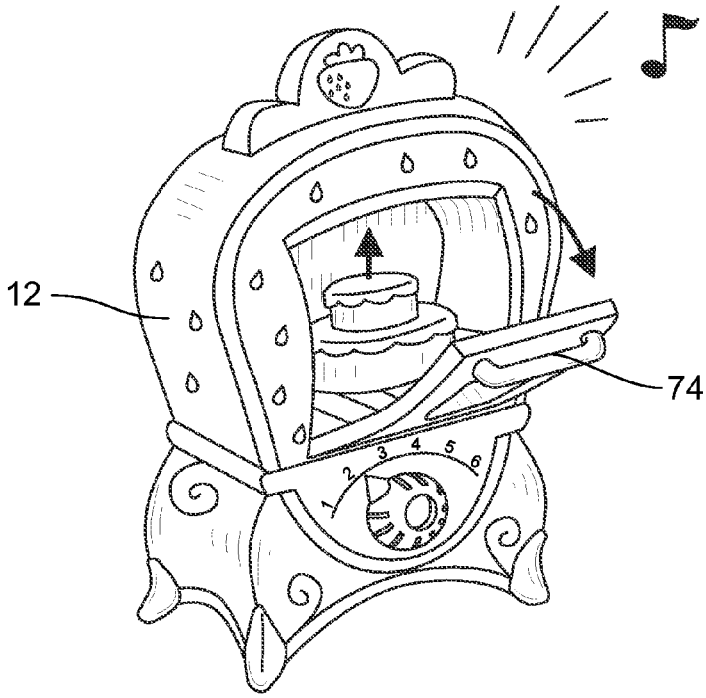
Figure 9B:
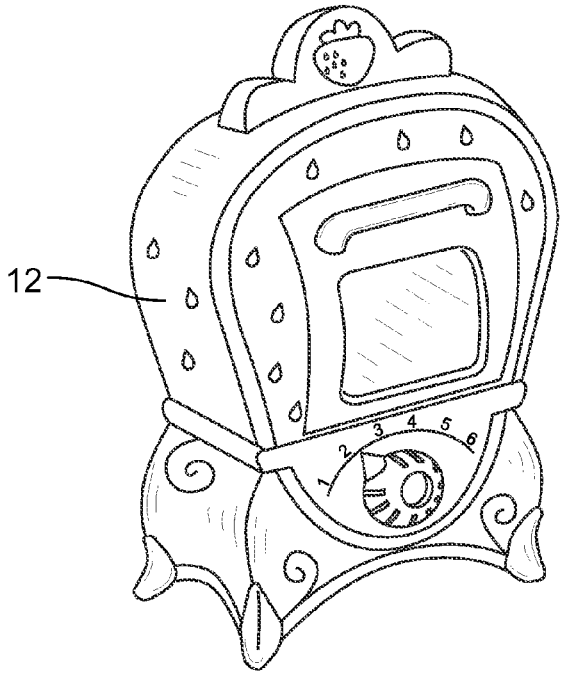
FIG. 9B illustrates the toy oven with the door traversed to the first closed position.

In an alternative embodiment of the invention, as seen in FIGS. 9A and 9B, the mechanical toy apparatus 10 can be incorporated into a stand alone oven including a hinged door 74 with finger 76 to contact the support structure or plunger 78 including a slot 80 which is biased to a non-engaging position, as seen in FIG. 3C. The symbolic structure 14 is mounted onto the base at the mounting portion 20 and as the door is opened the finger 76 rides in the slot of the plunger 78 causing the plunger to shift the symbolic structure to a rising position. When the oven door is then fully opened after the symbolic structure has shifted to the risen position, the finger 76 will fall out of the slot releasing the plunger 78 to be pulled from the mounting portion of the base with the assistance of a biasing spring 82. Additionally, music may play from the toy oven actuated by the opening the oven door further enhancing play for the user.

A method for transforming a symbolic structure with a lever structure in a toy or toy set apparatus includes the steps of providing a symbolic structure having a plurality of sections configured to transform between a first collapsing position and a second rising position, providing a base including a mounting portion for receiving the symbolic structure at the base, providing a support structure mounted at the base for contacting and enabling the symbolic structure to transform to the rising position, providing a lever structure affixed to the base to traverse between an engaging position and a non-engaging position at the support structure, and providing a cam mounted at the base for moving the support structure into engagement with the symbolic structure. Mounting the symbolic structure at the base actuates the cam and moving the lever structure to the engaging position causes the support structure to transform the symbolic structure to the rising position.

The method further includes providing a platform at the base upon which the removable symbolic structure is mounted and in mechanical communication with the cam, the platform further including an aperture through which the support structure extends to transform the symbolic structure to the rising position. The plurality of sections of the symbolic structure further includes one or more telescoping tiers extending from a fixed tier.

The method further including the steps of mounting the fixed tier on a plate and mounting the plate on the platform, wherein the plate further includes an edge for actuating the cam and an aperture through which the support structure extends to transform the one or more telescoping tiers to the rising position. The method further providing a play set and an extension wall removably affixed to the play set; and further including the steps of mounting the base to the extension wall and removably coupling the wall to the play set.

From the foregoing, it can be seen that there has been provided a unique mechanical toy apparatus operated by a lever structure transforming a removable symbolic structure in a way that is simple yet unique and exciting for a user. While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A mechanical toy apparatus, comprising: a symbolic structure having a plurality of sections configured to shift between a first collapsing position and a second rising position; a base including a mounting portion for receiving the symbolic structure at the base; a support structure mounted at the base for contacting and shifting the symbolic structure to the rising position; a lever structure affixed to the base to traverse between an engaging position and a non-engaging position at the support structure; and a guide structure comprising a cam and a slider linkage mounted at the base with the symbolic structure contacting with the cam to move the slider linkage, the support structure is positioned into contact with the lever structure to shift the symbolic structure to the second rising position; wherein the plurality of sections of the symbolic structure further includes one or more telescoping tiers extending from a fixed tier and wherein the fixed tier is further mounted on a plate including an edge for actuating the cam and an aperture through which the support structure extends to shift the one or more telescoping tiers to the second rising position.

2. The toy according to claim 1, wherein the support structure further includes a protrusion at an end of the support structure wherein the lever structure engages and lifts the support structure at the protrusion.

3. The toy according to claim 2, wherein the slider linkage of the guide structure at least partially envelopes the support structure biasing the support structure from engagement with the symbolic structure.

4. The toy according to claim 1, further comprising a platform at the mounting portion of the base upon which the symbolic structure is mounted and in mechanical communication with the cam, the platform further including an aperture through which the support structure extends to shift the symbolic structure to the second rising position.

5. The toy according to claim 1, further comprising a second lever and a linkage, wherein the linkage couples the second lever to the lever structure to traverse the lever structure between an engaging position and a non-engaging position.

6. The toy according to claim 5, wherein the second lever further includes a door affixed to traverse between a first closed position and a second open position at the base and in mechanical communication with the linkage, wherein the door causes the lever structure to move to the engaging position causing the support structure to raise the mounted symbolic structure to the second rising position when the door is opened to the second position, and further allowing the support structure to drop from mechanical communication with the symbolic structure when the door moves the lever structure to the non-engaging position.

7. The toy according to claim 4, wherein at least one of the telescoping tiers includes a portion having an interior ledge and at least one adjacent telescoping tier includes a portion having an exterior ridge.

8. The toy according to claim 4, wherein at least one of the telescoping tiers includes a portion having an interior ledge and at least one adjacent telescoping tier includes a portion having an exterior ridge forming a pressure fit between adjacent tiers for maintaining the tiers in a rising position when the exterior ridge abuts the interior ridge.

9. The toy according to claim 7, wherein the one or more telescoping tiers includes a top tier which further includes a post having a surface for engagement with the support structure.

10. The toy according to claim 4, wherein the base further includes one or more guiding ledges which define one or more slots at the platform for receiving the plate edge for actuating the cam and maintaining alignment of the plate and platform apertures.

11. A mechanical toy apparatus for use in a toy play set, comprising: a play set; an extension wall removably affixed to the play set; a symbolic structure having a plurality of sections configured to shift between a first collapsing position and a second rising position; a base affixed to the extension wall and including a mounting portion for receiving the symbolic structure at the base; a support structure mounted at the base for contacting and shifting the symbolic structure to the rising position; a lever structure affixed to the base to traverse between an engaging position and a non-engaging position at the support structure; and a guide structure comprising a cam and a slider linkage mounted at the base with the symbolic structure contacting with the cam to move the slider linkage, the support structure is positioned into contact with the lever structure to shift the symbolic structure to the second rising position; wherein the plurality of sections of the symbolic structure further includes one or more telescoping tiers extending from a fixed tier and wherein the fixed tier is further mounted on a plate including an edge for actuating the cam and an aperture through which the support structure extends to shift the one or more telescoping tiers to the second rising position.

12. The toy according to claim 11, wherein the slider linkage at least partially envelopes the support structure biasing the support structure out of engagement with the symbolic structure.

13. The toy according to claim 11, further comprising a platform at the base upon which the symbolic structure is mounted and in mechanical communication with the cam, the platform further including an aperture through which the support structure extends to move the symbolic structure to the rising position.

14. The toy according to claim 11, further comprising a second lever affixed at the lever structure to traverse the lever structure between an engaging position and a non-engaging position.

15. A mechanical toy apparatus, comprising: a symbolic structure having a plurality of sections configured to shift between a first collapsing position and a second rising position; a base including a mounting portion for receiving the symbolic structure at the base; a support structure mounted at the base for contacting and shifting the symbolic structure to the rising position; a lever structure affixed to the base to traverse between an engaging position and a non-engaging position at the support structure; a guide structure comprising a cam and a slider linkage mounted at the base with the symbolic structure contacting with the cam to move the slider linkage, the support structure is positioned into contact with the lever structure to shift the symbolic structure to the second rising position; a platform at the mounting portion of the base upon which the symbolic structure is mounted and in mechanical communication with the cam, the platform further including an aperture through which the support structure extends to shift the symbolic structure to the second rising position; and a second lever and a linkage, wherein the linkage couples the second lever to the lever structure to traverse the lever structure between an engaging position and a non-engaging position; wherein the plurality of sections of the symbolic structure further includes one or more telescoping tiers extending from a fixed tier and wherein the fixed tier is further mounted on a plate including an edge for actuating the cam and an aperture through which the support structure extends to shift the one or more telescoping tiers to the second rising position.

16. The toy according to claim 15, wherein at least one of the telescoping tiers includes a portion having an interior ledge and at least one adjacent telescoping tier includes a portion having an exterior ridge.

17. The toy according to claim 16, wherein the one or more telescoping tiers includes a top tier which further includes a post having a surface for engagement with the support structure.

18. The toy according to claim 15, wherein the base further includes one or more guiding ledges which define one or more slots at the platform for receiving the plate edge for actuating the cam and maintaining alignment of the plate and platform apertures.

* * * * *